US005529645A

United States Patent [19]

Oswalt

[11] Patent Number: 5,529,645

[45] Date of Patent: Jun. 25, 1996

[54] THIN WALL CASTING AND PROCESS

[75] Inventor: Kermit J. Oswalt, La Mirada, Calif.

[73] Assignee: Northrop Grumman Corporation, Los Angeles, Calif.

[21] Appl. No.: 245,177

[22] Filed: May 17, 1994

[51] Int. Cl.[6] ..... C22F 1/04

[52] U.S. Cl. ..... 148/549; 148/698; 148/702; 148/437; 164/349; 164/364; 164/DIG. 15

[58] Field of Search ..... 148/549, 698, 148/702, 437; 164/349, 364, DIG. 15

[56] References Cited

U.S. PATENT DOCUMENTS

| | | | |
|---|---|---|---|
| 377,729 | 2/1888 | Carter | 428/588 |
| 386,219 | 7/1888 | Price | 164/342 |
| 806,504 | 12/1905 | Schreiner | 249/53 R |
| 1,949,372 | 2/1934 | Graf | 164/342 |
| 2,246,578 | 6/1941 | De Salardi | 428/593 |
| 2,508,865 | 5/1950 | Lund | 249/60 |
| 3,844,011 | 10/1974 | Davies | 428/547 |
| 3,996,075 | 12/1976 | Furney, Jr. et al. | 148/698 |
| 4,035,536 | 7/1977 | Morrison | 428/118 |
| 4,212,343 | 7/1980 | Narasimhan | 164/64 |
| 4,965,138 | 10/1990 | Gonzalez | 428/593 |
| 5,108,668 | 4/1992 | Kallup | 264/23 |
| 5,263,533 | 11/1993 | Druschitz et al. | 164/349 |

*Primary Examiner*—David A. Simmons
*Assistant Examiner*—Robert R. Koehler
*Attorney, Agent, or Firm*—Terry J. Anderson; Karl J. Hoch, Jr.

[57] ABSTRACT

Thin wall lightweight panels which are subjected to high temperature solutioning and rapid quenching to impart high strength properties without distortion, warping or oil-canning. The panels are produced by casting in a mold cavity having an interconnected recess network which surrounds thin wall-forming areas and distributes molten metal uniformly thereto. The recess network forms a waffle pattern reinforcing rib network surrounding the thin-wall areas, lending strength and dimensional stability thereto during the heat treatment and quenching steps, to prevent distortion, warping and oil-canning.

5 Claims, 2 Drawing Sheets

THIN WALL CASTING AND PROCESS

BACKGROUND OF THE INVENTION

1. Field of the Invention

The present invention relates to the production of thin wall castings of metals, such as aluminum and alloys thereof, by casting processes such as sand casting followed by heat treatment and quenching to retain the necessary distortion, hardness and tensile properties. In known metal casting processes, a mold is provided and molten metal is poured thereinto to fill the mold cavity. After cooling, the mold is opened or broken away and the metal casting is removed, heat-treated to develop the necessary high strength properties, and quenched.

The casting of thin wall metallic elements, such as flat plates and similar articles, has been limited to the casting of minimum wall thicknesses of about 0.120 inch. Wall thicknesses below this minimum result in castings which warp or "oil can" during quenching and otherwise lack dimensional stability, strength and stiffness so as to be difficult to handle, non-uniform in dimensions and appearance, and deflective under load.

The necessity for thicker wall metal castings increases the weight and the cost of the castings, and requires the additional steps of chemical milling and/or machining in cases where some of the weight must be removed. Such steps involve additional time and expense and can result in the disadvantages discussed above if substantial amounts of wall metal are removed.

Thin wall metallic elements having stiffness and resistance to warping are conventionally produced by the weld assembly of several machined or formed parts. However such elements are either rolled from thin sheet material and formed, or are machined from thick plate and assembled, and therefore are more expensive.

SUMMARY OF THE INVENTION

The present invention relates to the discovery that thin wall metal castings which have wall thicknesses of from 20% to 40% less than conventional castings and yet have satisfactory stiffness, resistance to warpage, strength and deflection-resistance under load, can be produced by casting them in the form of a ribbed or waffle pattern comprising a plurality of thin wall areas interconnected with each other by means of a plurality of narrow intersecting ribs of increased thickness.

DETAILED DESCRIPTION OF THE INVENTION

Figure 1:
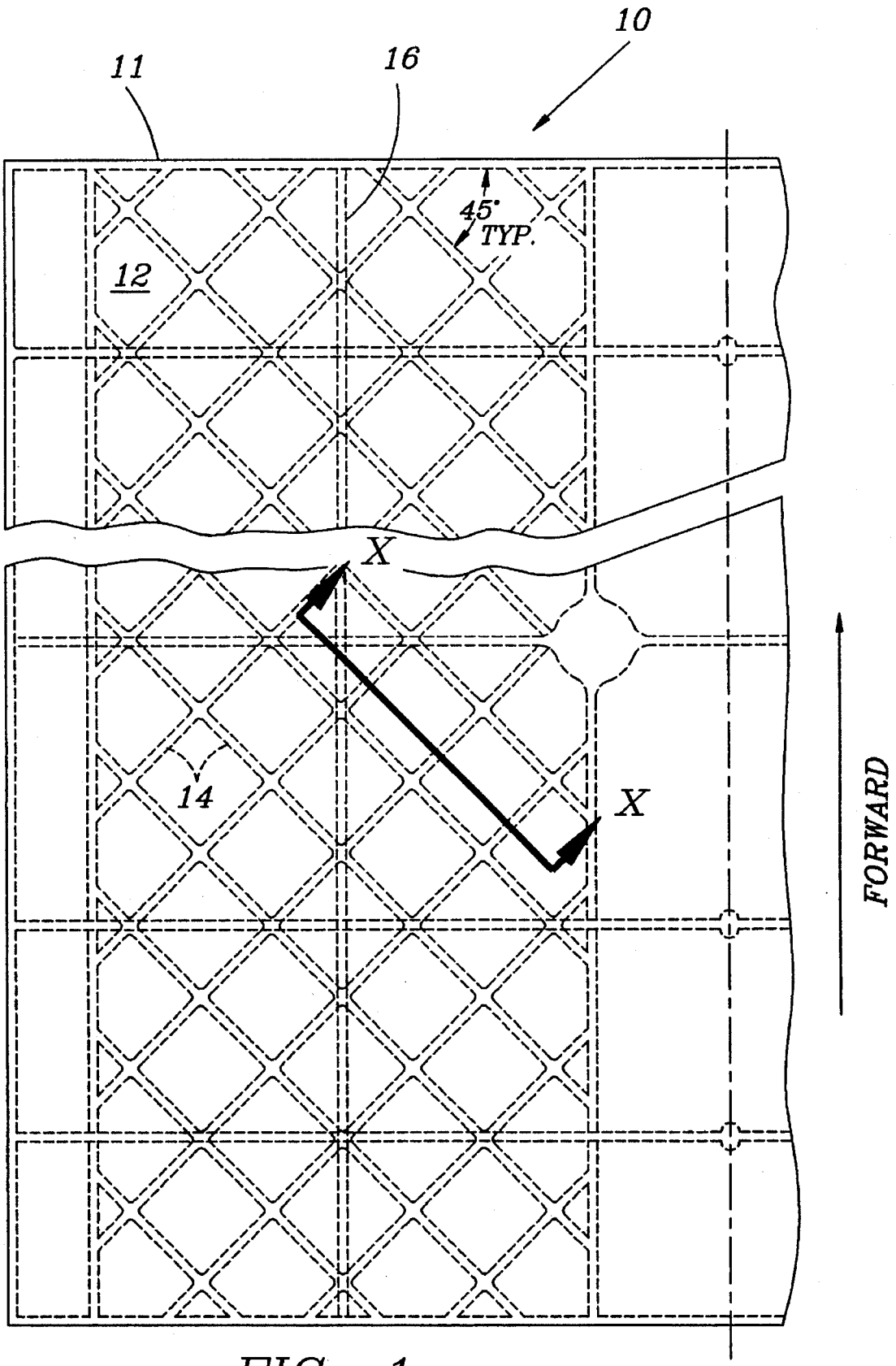
FIG. 1 is a plan view of a sectioned thin wall casting, illustrating the waffle pattern on one side of the casting by means of broken lines.
Figure 2:
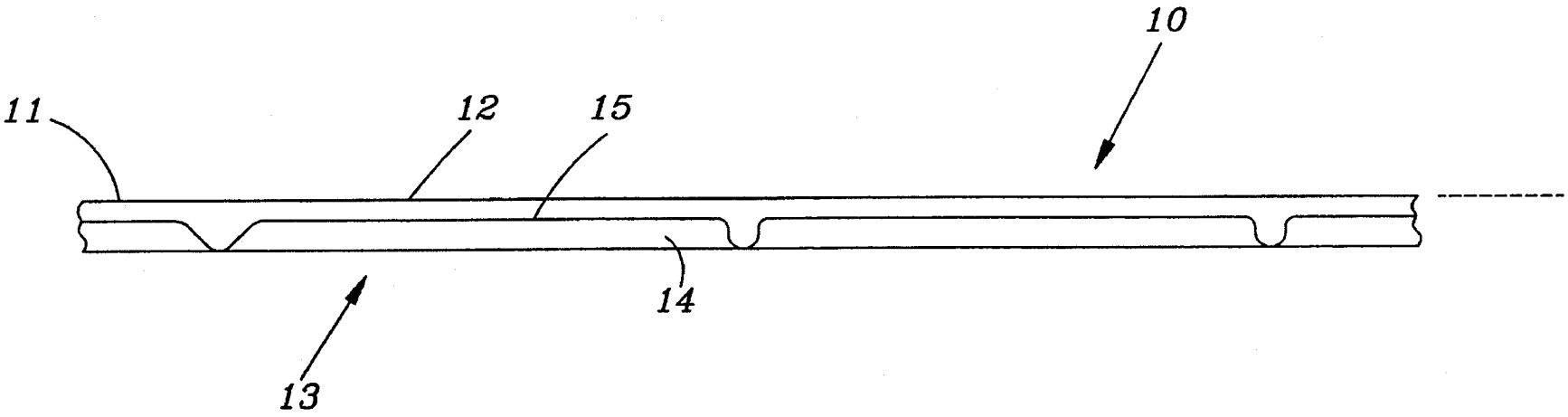
FIG. 2 is a vertical cross-section taken along the line X—X of FIG. 1.

Referring to the drawings, the casting 10 of FIG. 1 has a wall 11 having a continuous or smooth upper surface 12, and a waffle-pattern under-surface 13 formed by a plurality of integral raised intersecting ribs 14 enclosing and supporting thin wall areas 15, as illustrated most clearly by FIG. 2.

The present invention involves the discovery that while thin-wall castings, having a wall thickness less than about 0.120 inch, cannot be reliably cast, heat-treated and strengthened, to have sufficient dimensional stability, uniformity or strength, these problems in the casting process and in the cast products are overcome by forming the sand casting mold in two sections, one of which may have a flat, continuous or smooth surface and at least the opposed section having a waffle-pattern surface having smooth raised flat surface areas surrounded by a network of interconnected rib-forming recesses. When the mold sections are assembled, the flat surface areas of the waffle-pattern surface are parallel to the opposed flat surface areas of the other section and are uniformly spaced therefrom by a distance less than 0.1 inch, preferably between about 0.08 inch and 0.04 inch, most preferably about 0.06 inch, to form isolated narrow cavity areas which produce the thin wall areas of the casting.

The rib-forming recess network of the waffle pattern surface of the mold section has a uniform depth, below the flat surface areas which they surround, of between about 0.1 inch and 0.16 inch, preferably between about 0.13 inch and 0.15 inch, most preferably about 0.14 inch when the thin wall-forming space is about 0.06 inch. The width of the recesses is between about 0.1 inch and 0.04 inch, preferably about 0.06 inch.

In addition, the waffle pattern mold section is provided with a gating system to spaced inlet openings into the rib-forming recess network for the pressure-or-gravity-introduction of molten metal, such as aluminum alloy, to the recess network, whereby the molten metal fills said network and flows into the isolated narrow cavity areas between the mold sections, filling said areas with molten metal from the recess network which surrounds and isolates each such narrow cavity area from the next.

The fact that the recessed rib-forming areas are deeper than the isolated narrow cavity areas, and open thereto in all directions, permits the molten metal to flow deeper into the narrow cavity areas to fill said areas. After the casting operation, the cooled mold sections are parted, the gating system is removed and the formed castings are heat treated and finished. Castings 10 have a surface area which is predominantly composed of uniform thin wall areas 15, such as about 0.06 inch thick, surrounded and reinforced at the undersurface 13 by a network of raised intersecting ribs 14, such as having a thickness of about 0.14 inch below the areas 15, or about 0.20 inch including the thickness of the areas 15, and a width of 0.06 inch. A limiting factor of conventional thin wall lightweight aluminum alloy plates is the vulnerability of the material to warp or distort during the heat treat process necessary to develop the high strength properties desired in the final part. The strength of alloy is maximized when the heat treat process includes a heat-solutioning treatment at 900°–1100° F., followed by a quench and subsequent low temperature aging step. Internal stresses occur during the quenching process which normally can create distortion. The magnitude of the internal stresses is increased by a faster rate of heat removal; however, slower quench rates will result in a decrease of strength properties. Therefore for each part where strength is important, the quenching process must be developed to maximize the heat removal rate, yet prevent excessive distortion. Thin wall castings are particularly vulnerable to distortion since heat removal occurs at a relatively high rate regardless of the quench medium. For this reason distortion of conventional thin wall castings is usually difficult to control and requires post-quenching straightening procedures. A common form of distortion of conventional thin wall castings is "oil canning". This form of distortion usually occurs in an unsupported thin wall web area of the casting. The thin web area cools off quicker than the surrounding thicker area and therefore a thermal imbalance is developed which causes plastic deformation and creates a bulge in the area that is commonly termed "oil canning". This is permanent deformation that cannot be removed.

An evaluation was made to determine the effect of quenching rate on distortion as related to "oil canning" and strength of the present thin wall aluminum alloy castings.

This evaluation had two objectives: The first was to determine the amount of "oil canning"-type distortion occurring when a thin wall casting made according to the present invention is quenched at various cooling rates and the second objective was to determine the tensile strength properties of the present thin wall castings when quenched at cooling rates that are slow enough to avoid oil canning.

A sand-composite molded test casting 10 of 0.06 to 0.100 inch thin wall thickness in areas 15 with 0.14 to 0.2 inch high ribs 14, located as shown in FIGS. 1 and 2, was cast in aluminum alloy and heat treated to the desired condition using various quenching procedures. Melt chemistry of the test castings was controlled to assure a high magnesium content (0.55–0.65%) to optimize the strength capability of the material. The remainder of the chemistry was held to the normal limits of the alloy. Eighteen test castings were produced to a premium grade of radiographic quality. Each casting was serialized and dimensionally examined for flatness using a two-inch grid pattern. The test castings were divided into six groups of three castings in each group for heat treatment. The castings of each group were vertically positioned in a metal screen basket, solutionized in a furnace at 1010° F.±10° for 16 hours, and quenched by manual removal of the basket into the quench medium within 10 seconds after the door of the furnace was opened. The quench process for each group was varied to include the following:

Group 1: Quenched in room temperature water.

Group 2: Quenched in still, ambient air.

Group 3: Quenched in a salt bath at 325F.

Group 4: Quenched in a solution of 15% glycol and water.

Group 5: Quenched in a solution of 30% glycol and water.

Group 6: Quenched in a solution of 45% glycol and water.

The castings that were quenched in the salt bath were removed individually after aging periods of one, three and six hours. All castings were reexamined for flatness after removal from the quench. The dimensional change that occurred across the center section of the web area was plotted to show the distortion of flatness or oil canning which occurred in each casting. To evaluate the effect that the quenching processes may have had on the tensile properties, each casting was sectioned into six equal pieces and aged for different periods of time, varying from 0 to 10 hours. The results were recorded to show the aging response and tensile property capability of material processed by the various quenching methods.

The composition of each melt is shown in Table 1. All castings met Grade B radiographic quality requirements of MIL-STD-2175. Any defects, such as gas porosity, shrinkage and dross, were within the stringent limits of the specification.

TABLE 1

ALLOY COMPOSITION

| Aluminum Association Limits | | Melt Compositions | | | |
|---|---|---|---|---|---|
| Element | Content (%) | 570705 | 570703 | 570704 | 570706 |
| Silicon | 6.5–7.5 | 6.81 | 6.91 | 6.79 | 6.80 |
| Iron | 0.20 | 0.09 | 0.10 | 0.09 | 0.10 |
| Copper | 0.20 | 0.00 | 0.00 | 0.00 | 0.00 |
| Manganese | 0.10 | 0.00 | 0.00 | 0.00 | 0.00 |
| Magnesium | 0.40–0.7 | 0.61 | 0.60 | 0.59 | 0.60 |
| Zinc | 0.10 | 0.00 | 0.00 | 0.00 | 0.00 |
| Titanium | 0.10–0.20 | 0.15 | 0.15 | 0.15 | 0.16 |
| Beryllium | 0.04–0.07 | 0.057 | 0.055 | 0.058 | 0.046 |
| Others, Ea | 0.05 | | | | |
| Others, Total | 0.15 | | | | |
| Remainder | Aluminum | | | | |

No visual evidence of "oil canning" was noted in any of the "as-quenched" plates. The distortion measured across the center of the 8×4-inch (32 sq. in.) web area of each casting is listed in Table 2. These values were taken in 2-inch increments along the longitudinal centerline 16 of the casting 10 shown in FIG. 1. The most distortion was found in those castings that were quenched in room temperature water (RTW). These castings exhibited a variation of +0.037 to −0.026 inch. The distortion did not result in a concave or convex surface, such as normally produced when "oil canning" occurs but resulted from a bending or twisting movement of the entire casting.

TABLE 2

DIMENSIONAL CHANGE DETERMINED AT CENTERLINE OF EACH PLATE

| | | Dimensional Change ($\times 10^{-3}$ inch) | | | | |
|---|---|---|---|---|---|---|
| Quenchant | Plate | Area A | Area B | Area C | Area D | Area E |
| RTW | 50706-3 | +10 | +9 | +7 | +8 | +8 |
| | 50706-15 | −26 | −17 | −7 | +7 | +31 |
| | 50706-5 | +37 | +30 | +24 | +21 | −5 |
| 15% | 570703-1 | −1 | −3 | −0 | +2 | +9 |
| Glycol | 570706-2 | −18 | −17 | −7 | +1 | +9 |
| | 570706-8 | +7 | +4 | +2 | −3 | −5 |
| 30% | 570706-6 | −5 | −5 | −3 | +3 | +9 |
| Glycol | 570704-1 | −11 | −9 | −6 | +2 | +5 |
| | 570706-1 | −4 | −4 | −0 | +3 | +6 |
| 45% | 570706-10 | −6 | +8 | +8 | +6 | +6 |
| Glycol | 570706-11 | +3 | +1 | −0 | +5 | −2 |
| | 570706-14 | −18 | −10 | +2 | +10 | +16 |
| S/B | 570706-7 - 1 Hr | +6 | +3 | +3 | +2 | +1 |
| | 570706-13 - 3 Hr | −2 | −2 | +1 | +1 | +3 |
| | 570705 - 6 Hr | −11 | −8 | +1 | +8 | +15 |
| A/C | 570706-9 | −8 | −0 | −1 | −3 | +10 |
| | 570706-12 | +15 | +5 | +10 | +7 | −3 |
| | 570706-4 | −8 | −1 | +1 | +3 | +3 |

S/B - Salt bath at 325° F.
A/C - Still air cool at ambient temperature

Aging curves were plotted to summarize the effect of each quenching process on the material tensile properties. The results are tabulated in Table 3. The fastest and therefore more severe quench showed optimum strength properties of 54.8 ksi ultimate tensile strength, 48.3 ksi yield strength and 6.6% elongation after 3 hours of aging at 325° F. Longer aging periods of 6 to 10 hours did not significantly change the ultimate tensile strength (UTS), only slightly improved the yield strength (YS) and generally resulted in a decrease of ductility (%e) in the material regardless of the method of

THIN WALL CASTING AND PROCESS

BACKGROUND OF THE INVENTION

1. Field of the Invention

The present invention relates to the production of thin wall castings of metals, such as aluminum and alloys thereof, by casting processes such as sand casting followed by heat treatment and quenching to retain the necessary distortion, hardness and tensile properties. In known metal casting processes, a mold is provided and molten metal is poured thereinto to fill the mold cavity. After cooling, the mold is opened or broken away and the metal casting is removed, heat-treated to develop the necessary high strength properties, and quenched.

The casting of thin wall metallic elements, such as flat plates and similar articles, has been limited to the casting of minimum wall thicknesses of about 0.120 inch. Wall thicknesses below this minimum result in castings which warp or "oil can" during quenching and otherwise lack dimensional stability, strength and stiffness so as to be difficult to handle, non-uniform in dimensions and appearance, and deflective under load.

The necessity for thicker wall metal castings increases the weight and the cost of the castings, and requires the additional steps of chemical milling and/or machining in cases where some of the weight must be removed. Such steps involve additional time and expense and can result in the disadvantages discussed above if substantial amounts of wall metal are removed.

Thin wall metallic elements having stiffness and resistance to warping are conventionally produced by the weld assembly of several machined or formed parts. However such elements are either rolled from thin sheet material and formed, or are machined from thick plate and assembled, and therefore are more expensive.

SUMMARY OF THE INVENTION

The present invention relates to the discovery that thin wall metal castings which have wall thicknesses of from 20% to 40% less than conventional castings and yet have satisfactory stiffness, resistance to warpage, strength and deflection-resistance under load, can be produced by casting them in the form of a ribbed or waffle pattern comprising a plurality of thin wall areas interconnected with each other by means of a plurality of narrow intersecting ribs of increased thickness.

BRIEF DESCRIPTION OF THE DRAWINGS

FIG. 1 is a plan view of a sectioned thin wall casting, illustrating the waffle pattern on one side of the casting by means of broken lines; and FIG. 2 is a vertical cross-section taken along the line X—X of FIG. 1.

DETAILED DESCRIPTION OF THE INVENTION

Referring to the drawings, the casting 10 of FIG. 1 has a wall 11 having a continuous or smooth upper surface 12, and a waffle-pattern under-surface 13 formed by a plurality of integral raised intersecting ribs 14 enclosing and supporting thin wall areas 15, as illustrated most clearly by FIG. 2.

The present invention involves the discovery that while thin-wall castings, having a wall thickness less than about 0.120 inch, cannot be reliably cast, heat-treated and strengthened, to have sufficient dimensional stability, uniformity or strength, these problems in the casting process and in the cast products are overcome by forming the sand casting mold in two sections, one of which may have a flat, continuous or smooth surface and at least the opposed section having a waffle-pattern surface having smooth raised flat surface areas surrounded by a network of interconnected rib-forming recesses. When the mold sections are assembled, the flat surface areas of the waffle-pattern surface are parallel to the opposed flat surface areas of the other section and are uniformly spaced therefrom by a distance less than 0.1 inch, preferably between about 0.08 inch and 0.04 inch, most preferably about 0.06 inch, to form isolated narrow cavity areas which produce the thin wall areas of the casting.

The rib-forming recess network of the waffle pattern surface of the mold section has a uniform depth, below the flat surface areas which they surround, of between about 0.1 inch and 0.16 inch, preferably between about 0.13 inch and 0.15 inch, most preferably about 0.14 inch when the thin wall-forming space is about 0.06 inch. The width of the recesses is between about 0.1 inch and 0.04 inch, preferably about 0.06 inch.

In addition, the waffle pattern mold section is provided with a gating system to spaced inlet openings into the rib-forming recess network for the pressure-or-gravity-introduction of molten metal, such as aluminum alloy, to the recess network, whereby the molten metal fills said network and flows into the isolated narrow cavity areas between the mold sections, filling said areas with molten metal from the recess network which surrounds and isolates each such narrow cavity area from the next.

The fact that the recessed rib-forming areas are deeper than the isolated narrow cavity areas, and open thereto in all directions, permits the molten metal to flow deeper into the narrow cavity areas to fill said areas. After the casting operation, the cooled mold sections are parted, the gating system is removed and the formed castings are heat treated and finished. Castings 10 have a surface area which is predominantly composed of uniform thin wall areas 15, such as about 0.06 inch thick, surrounded and reinforced at the undersurface 13 by a network of raised intersecting ribs 14, such as having a thickness of about 0.14 inch below the areas 15, or about 0.20 inch including the thickness of the areas 15, and a width of 0.06 inch. A limiting factor of conventional thin wall lightweight aluminum alloy plates is the vulnerability of the material to warp or distort during the heat treat process necessary to develop the high strength properties desired in the final part. The strength of alloy is maximized when the heat treat process includes a heat-solutioning treatment at 900°–1100° F., followed by a quench and subsequent low temperature aging step. Internal stresses occur during the quenching process which normally can create distortion. The magnitude of the internal stresses is increased by a faster rate of heat removal; however, slower quench rates will result in a decrease of strength properties. Therefore for each part where strength is important, the quenching process must be developed to maximize the heat removal rate, yet prevent excessive distortion. Thin wall castings are particularly vulnerable to distortion since heat removal occurs at a relatively high rate regardless of the quench medium. For this reason distortion of conventional thin wall castings is usually difficult to control and requires post-quenching straightening procedures. A common form of distortion of conventional thin wall castings is "oil canning". This form of distortion usually occurs in an unsupported thin wall web area of the casting. The thin web area cools off quicker than the surrounding thicker area and therefore a thermal imbalance is developed which causes plastic deformation and creates a bulge in the area that is commonly termed "oil canning". This is permanent deformation that cannot be removed.

An evaluation was made to determine the effect of quenching rate on distortion as related to "oil canning" and strength of the present thin wall aluminum alloy castings.

This evaluation had two objectives: The first was to determine the amount of "oil canning"-type distortion occurring when a thin wall casting made according to the present invention is quenched at various cooling rates and the second objective was to determine the tensile strength properties of the present thin wall castings when quenched at cooling rates that are slow enough to avoid oil canning.

A sand-composite molded test casting 10 of 0.06 to 0.100 inch thin wall thickness in areas 15 with 0.14 to 0.2 inch high ribs 14, located as shown in FIGS. 1 and 2, was cast in aluminum alloy and heat treated to the desired condition using various quenching procedures. Melt chemistry of the test castings was controlled to assure a high magnesium content (0.55–0.65%) to optimize the strength capability of the material. The remainder of the chemistry was held to the normal limits of the alloy. Eighteen test castings were produced to a premium grade of radiographic quality. Each casting was serialized and dimensionally examined for flatness using a two-inch grid pattern. The test castings were divided into six groups of three castings in each group for heat treatment. The castings of each group were vertically positioned in a metal screen basket, solutionized in a furnace at 1010° F.±10° for 16 hours, and quenched by manual removal of the basket into the quench medium within 10 seconds after the door of the furnace was opened. The quench process for each group was varied to include the following:

Group 1: Quenched in room temperature water.

Group 2: Quenched in still, ambient air.

Group 3: Quenched in a salt bath at 325F.

Group 4: Quenched in a solution of 15% glycol and water.

Group 5: Quenched in a solution of 30% glycol and water.

Group 6: Quenched in a solution of 45% glycol and water.

The castings that were quenched in the salt bath were removed individually after aging periods of one, three and six hours. All castings were reexamined for flatness after removal from the quench. The dimensional change that occurred across the center section of the web area was plotted to show the distortion of flatness or oil canning which occurred in each casting. To evaluate the effect that the quenching processes may have had on the tensile properties, each casting was sectioned into six equal pieces and aged for different periods of time, varying from 0 to 10 hours. The results were recorded to show the aging response and tensile property capability of material processed by the various quenching methods.

The composition of each melt is shown in Table 1. All castings met Grade B radiographic quality requirements of MIL-STD-2175. Any defects, such as gas porosity, shrinkage and dross, were within the stringent limits of the specification.

TABLE 1

ALLOY COMPOSITION

| Aluminum Association Limits | | Melt Compositions | | | |
|---|---|---|---|---|---|
| Element | Content (%) | 570705 | 570703 | 570704 | 570706 |
| Silicon | 6.5–7.5 | 6.81 | 6.91 | 6.79 | 6.80 |
| Iron | 0.20 | 0.09 | 0.10 | 0.09 | 0.10 |
| Copper | 0.20 | 0.00 | 0.00 | 0.00 | 0.00 |
| Manganese | 0.10 | 0.00 | 0.00 | 0.00 | 0.00 |
| Magnesium | 0.40–0.7 | 0.61 | 0.60 | 0.59 | 0.60 |
| Zinc | 0.10 | 0.00 | 0.00 | 0.00 | 0.00 |
| Titanium | 0.10–0.20 | 0.15 | 0.15 | 0.15 | 0.16 |
| Beryllium | 0.04–0.07 | 0.057 | 0.055 | 0.058 | 0.046 |
| Others, Ea | 0.05 | | | | |
| Others, Total | 0.15 | | | | |
| Remainder | Aluminum | | | | |

No visual evidence of "oil canning" was noted in any of the "as-quenched" plates. The distortion measured across the center of the 8×4-inch (32 sq. in.) web area of each casting is listed in Table 2. These values were taken in 2-inch increments along the longitudinal centerline 16 of the casting 10 shown in FIG. 1. The most distortion was found in those castings that were quenched in room temperature water (RTW). These castings exhibited a variation of +0.037 to –0.026 inch. The distortion did not result in a concave or convex surface, such as normally produced when "oil canning" occurs but resulted from a bending or twisting movement of the entire casting.

TABLE 2

DIMENSIONAL CHANGE DETERMINED AT CENTERLINE OF EACH PLATE

| | | Dimensional Change ($\times 10^{-3}$ inch) | | | | |
|---|---|---|---|---|---|---|
| Quenchant | Plate | Area A | Area B | Area C | Area D | Area E |
| RTW | 50706-3 | +10 | +9 | +7 | +8 | +8 |
| | 50706-15 | –26 | –17 | –7 | +7 | +31 |
| | 50706-5 | +37 | +30 | +24 | +21 | –5 |
| 15% | 570703-1 | –1 | –3 | –0 | +2 | +9 |
| Glycol | 570706-2 | –18 | –17 | –7 | +1 | +9 |
| | 570706-8 | +7 | +4 | +2 | –3 | –5 |
| 30% | 570706-6 | –5 | –5 | –3 | +3 | +9 |
| Glycol | 570704-1 | –11 | –9 | –6 | +2 | +5 |
| | 570706-1 | –4 | –4 | –0 | +3 | +6 |
| 45% | 570706-10 | –6 | +8 | +8 | +6 | +6 |
| Glycol | 570706-11 | +3 | +1 | –0 | +5 | –2 |
| | 570706-14 | –18 | –10 | +2 | +10 | +16 |
| S/B | 570706-7 - 1 Hr | +6 | +3 | +3 | +2 | +1 |
| | 570706-13 - 3 Hr | –2 | –2 | +1 | +1 | +3 |
| | 570705 - 6 Hr | –11 | –8 | +1 | +8 | +15 |
| A/C | 570706-9 | –8 | –0 | –1 | –3 | +10 |
| | 570706-12 | +15 | +5 | +10 | +7 | –3 |
| | 570706-4 | –8 | –1 | +1 | +3 | +3 |

S/B - Salt bath at 325° F.
A/C - Still air cool at ambient temperature

Aging curves were plotted to summarize the effect of each quenching process on the material tensile properties. The results are tabulated in Table 3. The fastest and therefore more severe quench showed optimum strength properties of 54.8 ksi ultimate tensile strength, 48.3 ksi yield strength and 6.6% elongation after 3 hours of aging at 325° F. Longer aging periods of 6 to 10 hours did not significantly change the ultimate tensile strength (UTS), only slightly improved the yield strength (YS) and generally resulted in a decrease of ductility (%e) in the material regardless of the method of quenching. It was interesting to note that the material quenched and aged in 325° F. salt exhibited average tensile properties of UTS 54.3 ksi, YS 46.2 ksi and 7.9% elongation, which was very comparable to the properties of material quenched in room temperature water (RTW). Test castings that were air-cooled showed much lower ultimate and yield strength values but higher ductility than exhibited by the other materials. A maximum strength of 38.3 ksi was reached with an elongation of 9.0%. All materials quenched in RTW or mixtures of polyalkylene glycol and water indicated a significant increase in elongation during the initial hour or aging which was followed by a rapid decrease in elongation during subsequent aging. This phenomenon also occurred in the air-cooled material; however, the change of elongation was less pronounced.

TABLE 3

| | MATERIAL PROPERTY SUMMARY* | | | | | |
|---|---|---|---|---|---|---|
| | AGING TIME | TENSILE PROPERTIES | | | HARDNESS | CONDUCTIVITY |
| QUENCHANT | (Hours) | UTS (ksi) | YS (ksi) | e (%) | (HRE) | (% IACS) |
| Room Temp. Water | 0 | 43.8 | 26.4 | 12.1 | 91.0 | 33.5 |
| | ½ | 43.0 | 26.4 | 12.2 | 92.8 | 34.6 |
| | 1 | 45.6 | 30.2 | 19.0 | 92.8 | 35.2 |
| | 3 | 54.8 | 48.3 | 6.6 | 99.5 | 37.9 |
| | 6 | 54.2 | 48.5 | 5.3 | 101.0 | 38.4 |
| | 10 | 54.4 | 48.1 | 6.0 | 101.0 | 38.4 |
| 15% Glycol | 0 | 43.5 | 25.9 | 11.9 | 91.3 | 34.0 |
| | ½ | 42.6 | 25.2 | 13.7 | 90.7 | 35.0 |
| | 1 | 46.2 | 28.8 | 14.7 | 93.8 | 35.9 |
| | 3 | 53.9 | 45.8 | 10.2 | 100.2 | 38.0 |
| | 6 | 53.5 | 47.3 | 5.1 | 100.3 | 38.1 |
| | 10 | 53.9 | 48.0 | 5.3 | 100.6 | 38.5 |
| 30% Glycol | 0 | 43.0 | 26.2 | 11.3 | 90.3 | 34.4 |
| | ½ | 43.3 | 26.3 | 12.2 | 90.8 | 34.7 |
| | 1 | 46.8 | 29.2 | 15.6 | 92.7 | 35.2 |
| | 3 | 54.1 | 46.1 | 10.4 | 99.5 | 37.6 |
| | 6 | 53.4 | 46.4 | 5.0 | 99.8 | 37.6 |
| | 10 | 54.1 | 48.0 | 4.3 | 101.3 | 37.8 |
| 45% Glycol | 0 | 41.8 | 24.9 | 11.2 | 89.7 | 35.2 |
| | ½ | 41.5 | 25.1 | 12.0 | 89.5 | 36.3 |
| | 1 | 44.9 | 27.4 | 13.8 | 91.5 | 36.4 |
| | 3 | 51.9 | 43.8 | 8.3 | 98.5 | 38.3 |
| | 6 | 51.2 | 45.3 | 4.5 | 99.3 | 38.8 |
| | 10 | 51.4 | 46.5 | 4.3 | 99.8 | 38.7 |
| Salt Bath at 325 F. | 0 | — | — | — | — | — |
| | ½ | — | — | — | — | — |
| | 1 | 54.1 | 46.1 | 3.9 | 101.5 | 37.4 |
| | 3 | 54.3 | 46.2 | 7.9 | 100.0 | 38.3 |
| | 6 | 53.1 | 45.7 | 4.5 | 101.5 | 37.2 |
| | 10 | — | — | — | — | — |
| Air Cool | 0 | 32.0 | 17.6 | 11.5 | 76.8 | 37.6 |
| | ½ | 32.4 | 19.0 | 12.2 | 76.7 | 38.1 |
| | 1 | 33.3 | 18.8 | 12.7 | 76.2 | 39.4 |
| | 3 | 35.6 | 24.6 | 12.7 | 81.7 | 40.0 |
| | 6 | 37.3 | 27.2 | 9.2 | 84.2 | 39.7 |
| | 10 | 38.3 | 28.8 | 9.0 | 85.8 | 39.6 |

*Each value is the average of three tests.

The electrical conductivity and hardness measurements are summarized in Table 3. It was found that conductivity and hardness increased with aging time to a maximum, then leveled off without significant change with additional aging. The conductivity and hardness response of material quenched in the hot salt bath was constant for the limited aging times evaluated since maximum values were apparently reacted by the time the first readings were taken.

Dendrite arm spacing (DAS) measurements determined at the fracture area of tensile specimens excised from the test castings indicated a variation of 0.0008 to 0.0013 inch. The small DAS was attributed to the rapid solidification of the thin wall section of the casting. Chilling was only provided in the mold to develop radiographic soundness by progressive solidification from the longitudinal center line outward to the transverse rib areas.

It has been demonstrated that quenching procedures will not cause "oil canning" type distortion on the present waffle design thin wall cast material according to the present invention of a nominal 0.06 to 0.1 inch thickness in a configuration which contains a maximum unsupported web area of 32 and up to 60 square inches. Wall movement which caused general distortion was greatest when the material was quenched at the fastest cooling rate, i.e., in room temperature water. The distortion of all quenching methods except room temperature water was generally within a total variation of 0.030 inch for the 8-inch span of unsupported material. This is considered to be an acceptable flatness tolerance in most aerospace applications and would not require reworking of the castings, i.e., grinding or straightening, to salvage the part. Final tensile properties of the material were dependent upon the quenching method. However, with the exception of air-cooled material, the ultimate and yield strength values exceeded 51 ksi and 42 ksi, respectively. The good ductility, moderate strength and minimum distortion capability of salt bath quenched-aged material make it attractive for thin-wall complicated configurations. This investigation has shown that thin wall aluminum alloy castings with unsupported areas of 32 square inches and up to 60 square inches (6×10 sq. in.) heat treated to develop very good tensile properties without concern for "oil canning".

The following additional tests were conducted to determine the effects of other modifications of the waffle design panels produced according to the present invention.

To evaluate effect of enlarging the size of the unsupported web area, the web area was increased from 8×4 inches (32 square inches to 6×10 inches (60 square inches); the web thickness was at 0.1 inches nominal. The heat treat procedure included a room temperature water quench. Test results showed that Grade B radiographic quality was obtained without any incidence of oil canning in the web area.

To evaluate the effect of reducing the web thickness, the web thickness was reduced to 0.080 inch nominal. Ribs 14 which are 0.10 inch high×0.06 inch wide were added spaced one inch apart to form a waffle type pattern on one side of the panel only. A mixture of 15% glycol and water was used to quench the test castings. The web area met Grade B radiographic quality and no distortion was found.

To evaluate the effect of a larger web area and thinner web thickness, of the aforementioned one inch waffle pattern configuration, the waffle pattern size was increased from one square inch to four square inches (2×2 inch) and the thickness reduced from 0.080 to a normal of 0.060 inches to provide better feeding. Quenching procedures were not changed. Test illustrated that the Grade B Radiographic Quality was maintained and no evidence of distortion was found. Tensile strength of an excised specimen from a one inch vertical rib area of the panel was 50.9 ksi UTS, 41.2 ksi YS and 9% elongation.

To evaluate the effect of rotating the grid pattern, all dimensions and procedures remained the same as in the aforementioned sample but the waffle grid design was formed at an angle 45° from the longitudinal axis of the panel as illustrated in FIG. 1. Additional panels were poured in the aluminum alloy and were quenched in 200° F. water and aged to the desired condition. Dimensional stability and radiographic quality of the panels were not affected. No evidence of oil canning was noted within the web areas.

To evaluate the effect of machining excess metal from the web areas 12 to obtain a final thickness of 0.060 inches nominal, panels were molded having a web thickness of 0.130 inches. No other changes were made to the process. The excess material was machined off using a 2 inch diameter end mill. Panels were machined to the final, 0.060 inch thickness by two methods. One method used a single cut and the other method used two cuts. The panels which were machined to final thickness in a single cut were slightly more dimensionally stable however, no oil canning was noted in the web areas of plates machined by either method.

In summary, a 0.06 wall thickness can be produced in an aluminum alloy sand casting by incorporation of a 2 inch waffle grid pattern on one side of the wall. Heat treat distortion due to quenching stresses are not sufficient to cause "oil canning" in the 0.060 inch thick web areas of a two inch waffle pattern when 15% glycol and water mixture is used as the quenchant.

Grade B radiographic quality is producible in a 0.060 nominal thickness wall using a 2 inch waffle pattern. By using a 2 inch waffle pattern, final wall thickness of 0.060 may be achieved in the alloy panels by casting the wall oversize to a thickness of 0.130 and machining off the excess metal after final heat treatment.

As will be apparent to those skilled in the art, the present thin-wall, rib-reinforced structural members are lighter in weight and less expensive than prior known cast structures requiring wall thicknesses of at least about 0.12 inch, and are stronger, stiffer and more dimensionally-stable than walled structures machined to have thicknesses of 0.1 inch or less.

It will be apparent to those skilled in the art that the dimensions of the waffle pattern or rib network are variable depending upon the overall dimensions of the cast element. Most preferably the waffle pattern has a square configuration so that opposed ribs are uniformly spaced in both directions. The opposed ribs generally are spaced by between 1 and 4 inches, preferably by between 2 and 3 inches.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. Process for forming a lightweight cast aluminum alloy panel having surface areas having a uniform wall thickness of about 0.1 inch or less, but which are capable of undergoing high temperature heat treatment and rapid quenching to produce solutioning and high strength properties without distortion, warping or oil canning, comprising providing a mold having a cavity in the form of an interconnected rib-forming recess network with thin wall cavity areas therebetween in a waffle pattern, said thin wall cavity areas being open to said recess network in all directions to permit molten casting metal to flow from said recess network and fill said thin wall cavity areas; introducing molten aluminum alloy casting metal to fill said network and the thin wall areas therebetween; cooling and opening said mold, and removing the thin wall cast panel consisting of said cast aluminum alloy and having surface areas having a uniform wall thickness which is about 0.1 inch or less, and comprising an interconnecting cross-sectional network of reinforcing ribs of cast metal in the form of a waffle pattern, heating said casting consisting of said cast aluminum alloy to an elevated solutioning temperature between about 900° and 1100° F. and rapidly quenching the casting by immersion in a liquid quenching bath, to impart high strength properties thereto, said waffle pattern of reinforcing ribs imparting strength and dimensional stability against distortion, warping and oil canning to said thin wall cast panel.

2. Process according to claim 1 in which said cast panel is formed to have one flat surface and said recess network has a depth sufficient to form ribs between about 0.1 inch and 0.16 inch in height extending from the opposite surface of the cast panel.

3. A thin wall cast panel consisting of cast aluminum alloy and comprising an integral interconnected network of raised reinforcing ribs in the form of a waffle pattern uniformly distributed thereover, said ribs having therebetween thin wall areas having a thickness between about 0.04 inch and 0.1 inch, said cast panel consisting of cast aluminum alloy having been heated to an elevated solutioning temperature between about 900° and 1100° F. and rapidly quenched to impart high strength properties thereto, and being stabilized by said waffle pattern of reinforcing ribs against distortion, warping and oil-canning resulting from said heating and quenching.

4. A thin wall cast according to claim 3 in which said thin wall surface panel areas comprise the major surface area of said casting and have a wall thickness of about 0.06 inch.

5. A thin wall casting according to claim 3 in which said panel has one flat surface and one waffled surface, and said ribs have a height of between about 0.13 inch and 0.15 inch extending from the waffled surface.

* * * * *